US006179170B1

(12) United States Patent
Bachand

(10) Patent No.: US 6,179,170 B1
(45) Date of Patent: Jan. 30, 2001

(54) DISPENSER ASSEMBLY AND INSERT TANK FOR SAME

(76) Inventor: George M. Bachand, 389J Wyassup Rd., No. Stonington, CT (US) 06359-1136

( * ) Notice: Under 35 U.S.C. 154(b), the term of this patent shall be extended for 0 days.

(21) Appl. No.: 09/301,379

(22) Filed: Apr. 27, 1999

(51) Int. Cl.[7] ..... B65D 83/14

(52) U.S. Cl. ..... 222/402.19; 222/321.5; 222/321.9; 222/321.4; 222/383.1; 222/385

(58) Field of Search ..... 222/321.4, 321.5, 222/321.9, 377, 383.1, 385, 402.19

(56) References Cited

U.S. PATENT DOCUMENTS

| | | | | |
|---|---|---|---|---|
| Re. 33,235 | | 6/1990 | Corsette | 222/383 |
| 3,447,551 | * | 6/1969 | Braun | 222/402.19 |
| 3,998,363 | | 12/1976 | Beres et al. | 222/321 |
| 4,129,235 | | 12/1978 | Haas | 222/321 |
| 4,214,677 | | 7/1980 | Bauer et al. | 222/145 |
| 4,220,264 | | 9/1980 | Gamadia | 222/207 |
| 4,260,082 | | 4/1981 | Rooney et al. | 222/340 |
| 4,966,313 | | 10/1990 | Lina | 222/402.19 |
| 4,978,038 | * | 12/1990 | Sullivan | 222/402.19 |
| 5,129,551 | | 7/1992 | Gott | 222/135 |
| 5,205,442 | | 4/1993 | Harris et al. | 222/341 |
| 5,222,636 | * | 6/1993 | Meuresch | 222/321.4 |
| 5,316,185 | | 5/1994 | Meenan | 222/321 |
| 5,346,104 | * | 9/1994 | Jeong | 222/402.19 |
| 5,348,199 | * | 9/1994 | Smith | 222/402.19 |
| 5,363,992 | | 11/1994 | Meshberg | 222/309 |
| 5,364,198 | | 11/1994 | Skendert | 401/138 |
| 5,377,869 | | 1/1995 | Weiss et al. | 222/1 |
| 5,392,962 | | 2/1995 | Meshberg | 222/321 |
| 5,411,183 | | 5/1995 | Hilderbrandt | 222/399 |
| 5,439,141 | | 8/1995 | Clark et al. | 222/136 |
| 5,474,210 | | 12/1995 | Boyd | 222/1 |
| 5,492,275 | | 2/1996 | Crampton | 239/333 |
| 5,509,578 | | 4/1996 | Livingstone | 222/82 |
| 5,570,840 | | 11/1996 | Gettinger et al. | 239/112 |
| 5,803,319 | | 9/1998 | Smith et al. | 222/402.19 |

* cited by examiner

*Primary Examiner*—J. Casimer Jacyna
(74) *Attorney, Agent, or Firm*—Bachman & LaPointe, P.C.

(57) ABSTRACT

A dispenser includes a container defining a main reservoir for holding a liquid product; a nozzle assembly connected to the container for dispensing liquid from the container; and an inner tank member disposed in the container and defining an active reservoir for holding the liquid product. The inner tank member includes an inlet communicating the active reservoir with the main reservoir, and the nozzle assembly is communicated with the active reservoir.

21 Claims, 7 Drawing Sheets

DISPENSER ASSEMBLY AND INSERT TANK FOR SAME

BACKGROUND OF THE INVENTION

The invention relates to a dispenser assembly and, more particularly, to an insert tank member which allows for inverted and upright use of the dispenser, without the use of a dip tube extending to the bottom of the dispenser.

Dispensers are widely used for dispensing various products such as household cleaners, hair spray, perfume, deodorant products, and the like, to name a few. Such dispensers typically employ either a trigger or finger pump assembly for directing a stream of fluid, or pressurized gas for forming an aerosol upon depression of a button spray nozzle. In either case, it is common for the pump or spray assembly to include a dip tube which must be immersed in liquid product to be dispensed in order to provide proper dispensing of the liquid. This leads to frequent problems when using the dispenser in an inverted position, since the tip of the dip tube can be exposed extending upward out of the liquid supply.

A number of efforts have been made in order to attempt to address this problem. Despite these efforts, however, the need remains for a reliable and effective mechanism whereby a dispenser can be operated in an inverted position.

It is therefore the primary object of the present invention to provide a dispenser which can be operated in inverted and other non-upright positions as well as in the upright position.

It is a further object of the present invention to provide such a dispenser having a simple and reliable structure.

It is a still further object of the present invention to provide an insert member which can be employed in a wide variety of conventional dispenser assemblies so as to allow such dispenser assemblies to be operated in inverted and/or non-upright positions.

Other objects and advantages of the present invention will appear hereinbelow.

SUMMARY OF THE INVENTION

In accordance with the present invention, the foregoing objects and advantages have been readily attained.

In accordance with the invention, a dispenser is provided which comprises a container defining a main reservoir for holding a liquid product; a nozzle assembly connected to said container for dispensing liquid from said container; and an inner tank member disposed in said container and defining an active reservoir for holding said liquid product, said inner tank member including an inlet communicating said active reservoir with said main reservoir, said nozzle assembly being communicated with said active reservoir.

In further accordance with the present invention, an insert is provided for a dispenser, which insert comprises a substantially cylindrical member having a sidewall defining an inner space and having an open end and a closed end; an inlet in said sidewall for allowing flow from exterior of said member to said inner space; and a valve in said closed end for selectively blocking and allowing flow through said closed end.

The insert and dispenser of the present invention are readily useful for trigger-operated pumps or spray assemblies, finger pumps, pressurized aerosol dispensers and the like.

BRIEF DESCRIPTION OF THE DRAWINGS

A detailed description of preferred embodiments of the present invention follows, with reference to the attached drawings, wherein.

DETAILED DESCRIPTION

The invention relates to the field of dispenser assemblies and, more particularly, to a dispenser and insert member for same which advantageously allows for inverted use of the dispenser.

As set forth above, a common problem encountered in the field of dispenser assemblies is the inability of such assemblies to operate when inverted. This is due to the fact that such assemblies include a dip tube which extends into a reservoir of liquid to be dispensed. The dip tube supplies liquid to the valve nozzle assembly and is typically exposed to air or head space in such a container when the container is positioned in non-upright positions. Obviously, this results in head space air or other gaseous material being drawn into the dip tube and dispensed, rather than the intended product.

In accordance with the present invention, a dispenser and insert tank member are provided which allow for use of a dispenser including same in an inverted position.

Figure 2:
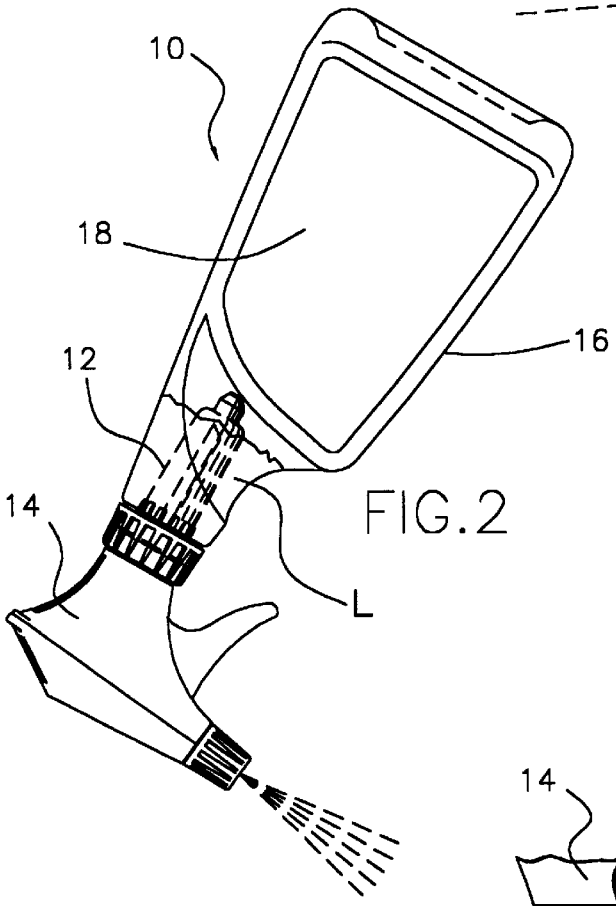
FIG. 2 is an inverted view of the dispenser of FIG. 1.
Figure 1:
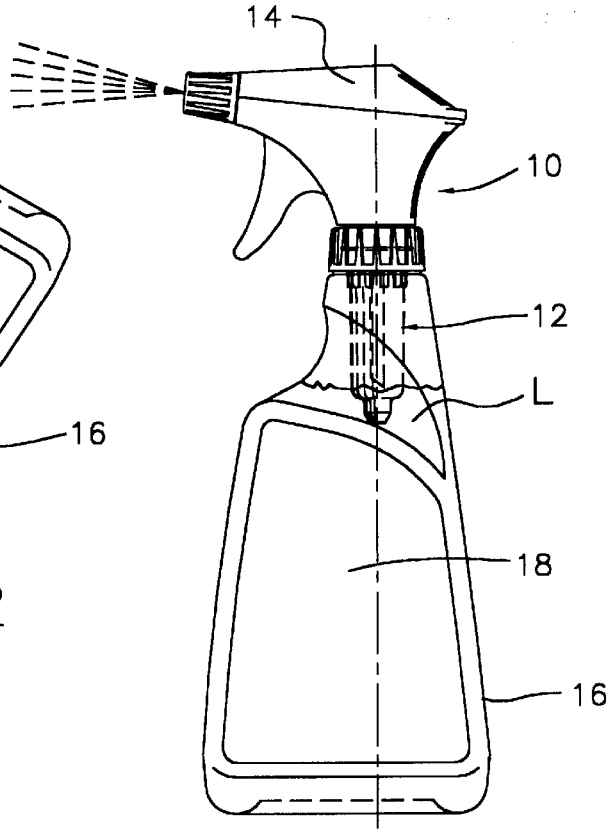
FIG. 1 is a side view of a dispenser including an insert in accordance with the present invention.

FIGS. 1 and 2 show side views of a dispenser 10 including an insert member 12 according to the invention which allows for operation of dispenser 10 in upright and non-upright positions. Dispenser 10 in this embodiment has a trigger pump nozzle or spray assembly 14 and a container portion 16 which defines a main reservoir area 18 for containing liquid product L to be dispensed.

Figure 3:
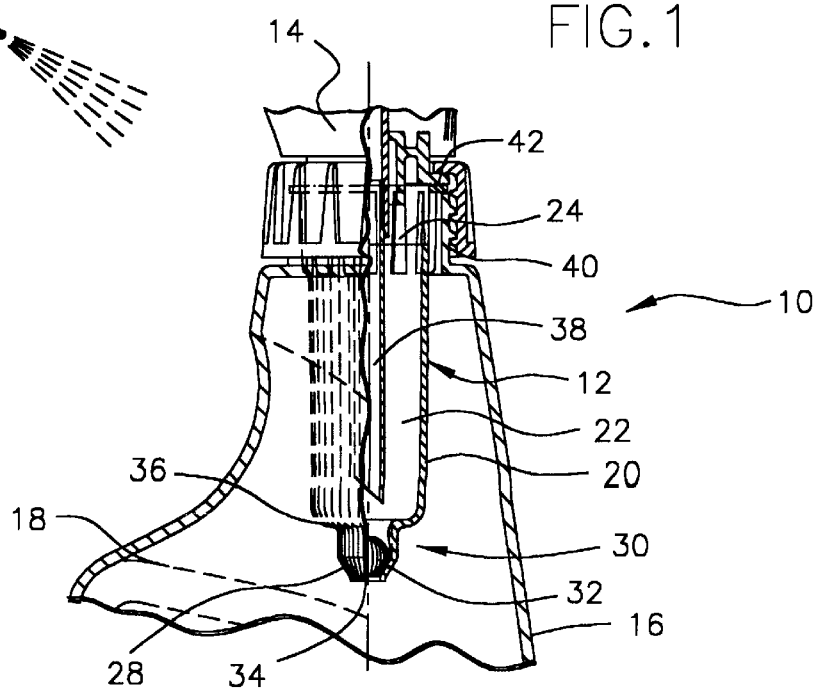
FIG. 3 is a partially sectional enlarged view of a portion of the dispenser of FIG. 1 including an insert member in accordance with the present invention.
Figure 4:
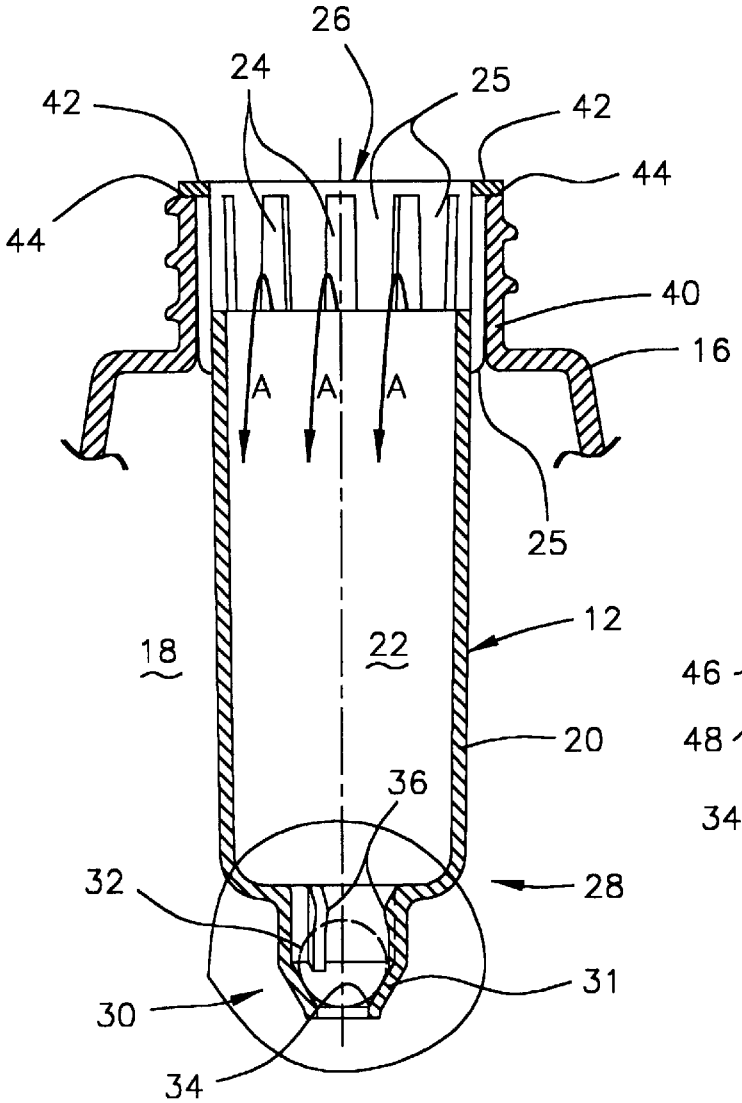
FIG. 4 is sectional view of the insert member of FIG. 3.
Figure 5:
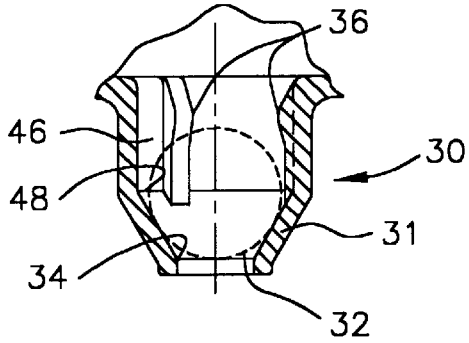
FIG. 5 is an enlarged view of a portion of FIG. 4.

Referring also to FIGS. 3–5, insert member 12 in accordance with the present invention preferably includes a substantially cylindrical sidewall 20 defining an inner space or active reservoir area 22. According to the invention, insert member 12 is preferably mounted within container 16 in fluid communication with main reservoir area 18.

According to the invention, insert member 12 has an inlet in sidewall 20, which in this embodiment is defined as a series of vertical openings or slots 24 positioned around the periphery of an upper portion of insert member 12 and extending through the thickness of sidewall 20. When inverted, slots 24 advantageously allow flow of liquid from main reservoir 18 into inner space 22 as indicated by arrows A in FIG. 4.

Sidewall 20 of insert member 12 preferably has an upper open end 26 and a lower closed or valved end 28. Slots 24 are preferably positioned in the upper portion of insert member 12 for reasons that will be discussed below.

In further accordance with the invention, insert member 12 preferably includes a valve member 30, preferably positioned at closed end 28. Valve member 30 preferably includes structure defining a gravity-operated valve, which assumes an open or closed position based upon vertical orientation of same. As shown, valve member 30 may include a ball member 32 and a ball seat 34 defined by sidewall 20. Valve member 30 preferably further includes structure such as valve retainers 36 extending inwardly over seat 34 so as to define an enclosed area within which ball member 32 is movable between a sealing and an open position. When valve member 30 is positioned in an inverted position, ball member 32 moves out of sealing engagement with seat 34 so as to allow flow, especially flow of air from within insert member 12, through valve member 30 as desired. In the upright position, ball member 32 is urged by gravity into sealing engagement with seat 34 as desired so as to maintain a supply of liquid in inner space 22.

Dispenser 10 in accordance with the present invention may be used with pump or trigger spray dispensers such as the dispenser illustrated in FIGS. 1–3, or alternatively may be used with aerosol and/or finger spray dispensers which will be discussed further below, or in any other application normally involving a liquid reservoir and a dip tube.

In any of these configurations, the spray or pump assembly preferably includes a relatively short dip tube 38 extending from pump assembly 14 into active reservoir area 22 of insert member 12 for example as shown in FIG. 3. Dip tube 38 preferably extends substantially the full length of insert member 12.

In use, dispenser 10 is initially inverted to a substantially upside-down position, for example as shown in FIG. 2. This causes ball member 32 to disengage from seat 34 so as to open valve member 30 for fluid flow therethrough. Liquid flows to the upper or neck portion 40 of container 16 and enters active reservoir area 22 from main reservoir area 18 through slots 24, while air or other gas trapped within insert member 12 exits through open valve member 30. Dispenser 10 can be operated in this orientation, if desired. Dispenser 10 can also at this point be returned to an upright position as illustrated in FIG. 1. This upright position causes ball member 32 to return to seat 34 and thereby close valve member 30 to fluid flow. This traps a full supply of liquid product within active reservoir area 22 for dispensing as desired.

Insert 12 is preferably sized so as to have sufficient capacity for allowing a reasonable number of bursts or applications of product, for example at least several and preferably 18–20 or more sprays or applications. Once active reservoir area 22 is exhausted, simple inversion of dispenser 10 to the position of FIG. 2 will re-fill insert member 12 for additional use as desired.

It should be readily apparent that dispenser 10 and insert member 12 in accordance with the present invention advantageously provide a dispenser 10 which can be effectively operated in any orientation. Further, dispenser 10 and insert member 12 according to the invention also allow for a nearly total use or expulsion of liquid product from container 16 since even a very small remaining volume of liquid within container 16 can easily be positioned into active reservoir area 22 through inversion of dispenser 10.

FIGS. 4 and 5 further illustrate the insert member 12 of FIGS. 1–3 in accordance with the present invention. FIG. 4 shows a cross sectional view of insert member 12 having sidewall 20 in the form of a substantially cylindrical member having open upper end 26 and closed lower end 28 with valve member 30. Sidewall 20 defines active reservoir area 22. Insert member 12 may be provided with a radially outwardly extending flange 42 which is adapted for engagement with neck portion 40 of dispenser 10. Flange 42 is preferably sized to rest upon an upper surface 44 of neck portion 40. of course, insert member 12 could be engaged with dispenser 10 in other ways if desired.

FIG. 4 shows slots 24 defined about a radial periphery and positioned substantially adjacent to upper open end 26. In this embodiment, ribs 25 are positioned extending radially outwardly between slots 24. Ribs 25 serve to provide additional flow area for liquid to flow into insert member 12 through slots 24 as desired.

As shown, slots 24 are preferably positioned higher on sidewall 20 than valve member 30. This positioning helps to ensure flow of liquid into insert member 12 through slots 24 and escape of air through valve member 30 when insert member 12 is inverted.

It should be appreciated that insert member 12 need not be cylindrical, and could be provided having a different shape, for example rectangular, square, oval and the like, as may be dictated by the shape of the container. Further, the inlet for allowing flow from main reservoir 18 into active reservoir area 22 could be provided as a different number of slots from that illustrated, or as differently shaped slots, or as different flow passage structures.

FIG. 5 shows an enlarged portion of FIG. 4 further illustrating the structure of valve member 30. Valve member 30 includes sidewall 31 defining a ball housing or chamber 46 for ball member 32 of valve member 30. As shown, sidewall 31 may be tapered so as to define seat 34 preferably having an internal diameter which is smaller than a maximum diameter of ball member 32. Sidewall 31 preferably extends to a maximum valve chamber diameter 48 which is larger than the maximum diameter of ball member 32. Valve retainer structures 36 may suitably be radially spaced around an internal surface of sidewall 31 and positioned substantially above seat 34 so as to allow sufficient room for ball member 32 to be displaced from seat 34 by gravity, while nevertheless maintaining ball member 32 in a controlled and close proximity to seat 34 to insure reliable movement of ball member 32 back to the engaging position with seat 34 for closing valve member 30 when insert member 12 is oriented in an upright position. Thus, valve retainers 36 preferably extend inwardly beyond the maximum diameter of ball member 32 so as to confine ball member 32 within chamber 46 as desired. In this embodiment, sidewall 31 is an extension of sidewall 20. Alternatively, sidewall 31 could be a separate structure attached to insert member 12.

A wide variety of alternative structures could of course be used so as to provide a desirable valve member 30 for use in releasing trapped air or other gases from insert member 12 when insert member 12 is in the inverted position, and also for use in sealing closed end 28 against fluid flow when insert member 12 is in the upright position.

As used herein, the upright position refers to a position of insert member 12 where open upper end 26 is positioned vertically higher than closed end 28, and an inverted position refers to a position where closed end 28 is positioned vertically higher than upper open end 26.

Figure 6:
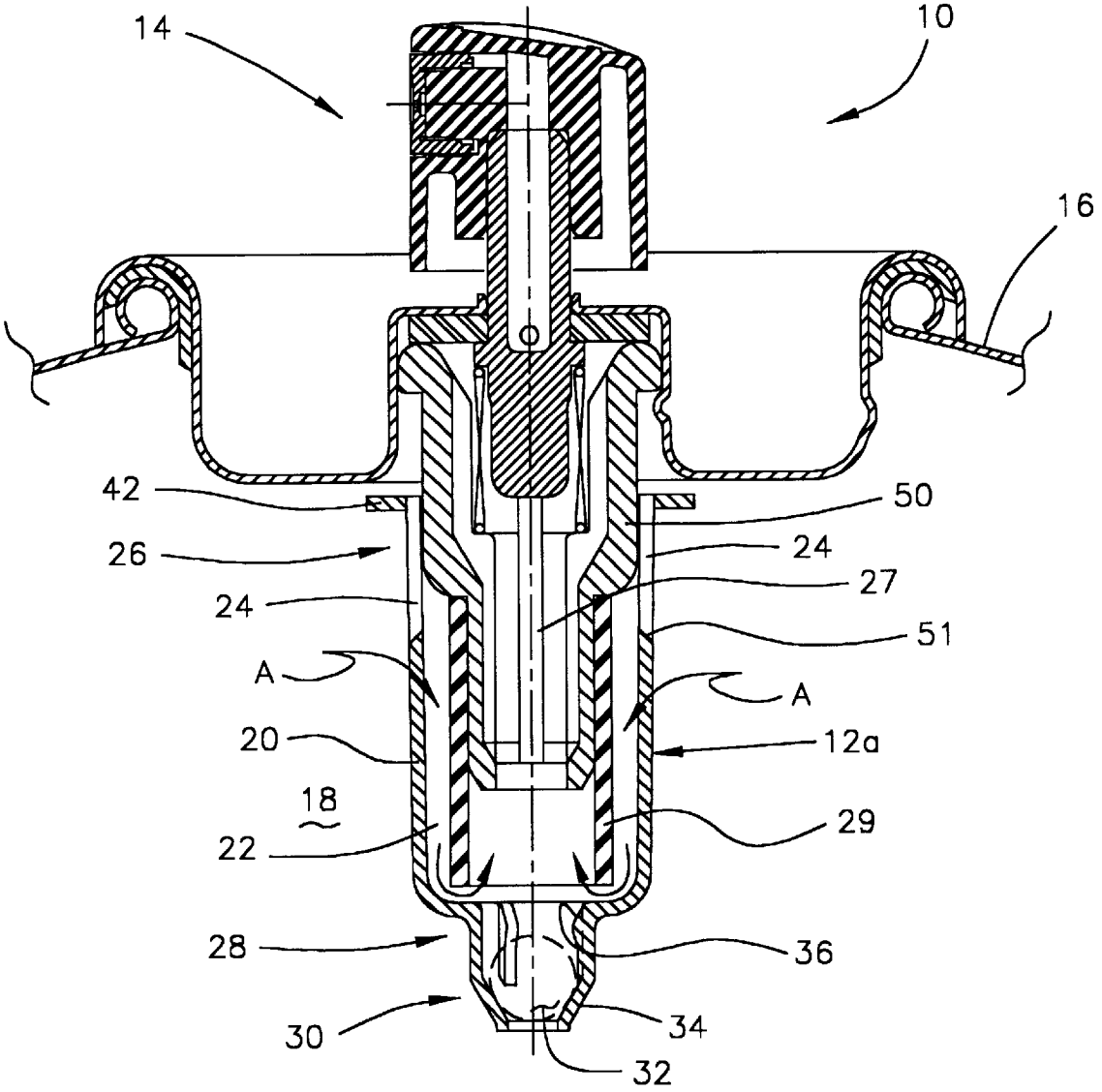
FIG. 6 is a side sectional view of an aerosol spray dispenser including an insert member in accordance with the present invention.
Figure 7:
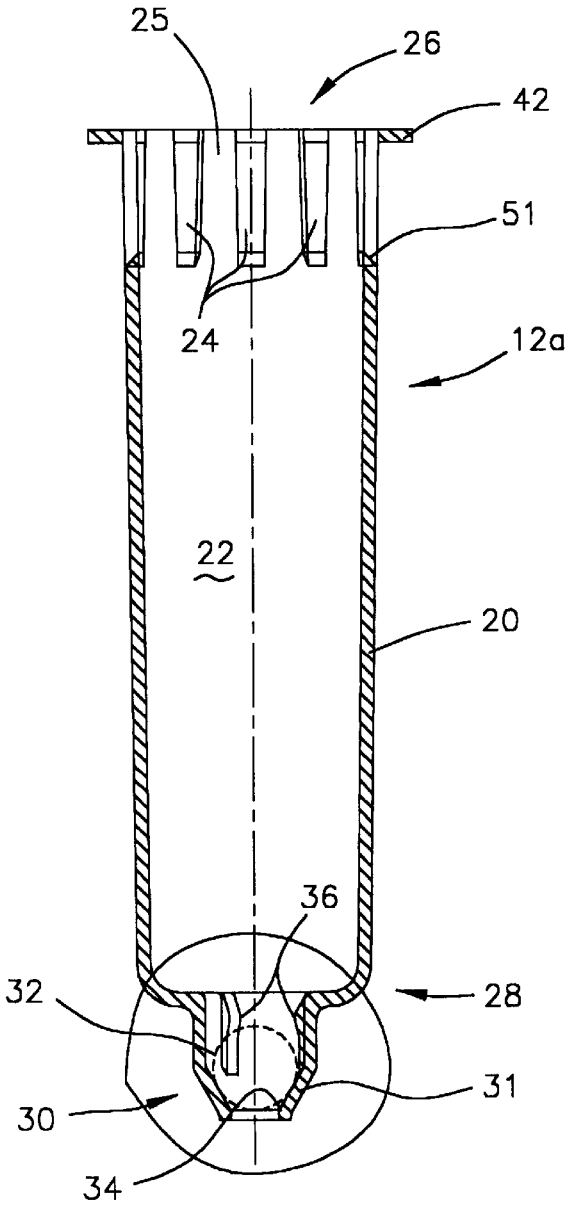
FIG. 7 is a sectional view of the insert member of FIG. 6.
Figure 8:
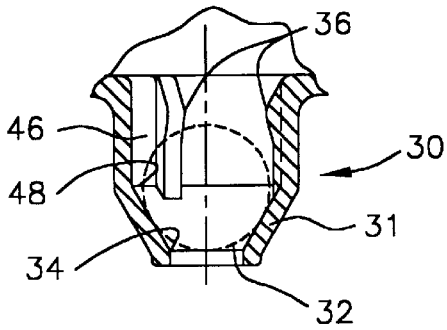
FIG. 8 is an enlarged view of a portion of FIG. 7.

FIGS. 6–8 illustrate an embodiment of insert member 12*a* for use in accordance with the present invention with aerosol spray type dispensers. FIG. 6 shows a spray assembly 14 of a typical aerosol sprayer, and shows insert member 12*a* mounted to a member or component 50 of spray assembly 14. Aerosol containers typically include liquid and gaseous contents which are contained within the container at a pressure sufficiently higher than ambient pressure that opening of spray or nozzle assembly 14 causes a mixture of gas and atomized liquid to be dispensed. As with the trigger spray dispensers, inversion of an aerosol spray assembly can result in only gaseous medium being dispensed, which of course is undesirable.

In accordance with the present invention, insert member 12 can be mounted for use with aerosol spray assembly 14 for example through frictional engagement with member 50 as shown in FIG. 6, or could be mounted in other ways so as to communicate with main reservoir 18 and nozzle assembly 14 as desired.

Insert member 12*a* of the embodiment of FIGS. 6–8 is similar in most respects to insert member 12 of FIGS. 4–5. As shown, insert member 12*a* includes wall member 20 defining inner active reservoir area 22. Insert member 12*a* has upper open end 26 and lower closed end 28, and valve member 30 positioned at lower closed end 28. In this embodiment, insert member 12*a* has a substantially smooth outer wall in the area of slots 24, in contrast to ribs 25 of the embodiment of FIGS. 4 and 5. As shown in FIGS. 6 and 7, slots 24 may be defined having a sloped lower wall 51 which in the upright position slopes upwardly and inwardly. Sloped wall 51 may enhance free flow of liquid to and through slots 24 into insert member 12*a* as desired.

In the embodiment of FIG. 6, a typical aerosol nozzle assembly 14 is shown including an inlet member 27 through which liquid and gas are drawn. It may be desirable in accordance with the present invention to provide a short dip tube 29, for example, telescopically received over inlet 27, and extending substantially the same interior length as insert member 12*a* preferably so as to terminate substantially adjacent to valve member 30. As with dip tube 38 of the embodiment of FIGS. 1–5, dip tube 29 is preferably adapted to extend only the interior length of insert member 12*a,* and not the entire length of the main reservoir container.

FIGS. 7 and 8 illustrate insert member 12*a* in greater detail. Insert 12*a* of this embodiment includes flange 42 and openings or slots 24 extending through sidewall 20 and a portion of the thickness of flange 42. Valve 30 of FIG. 8 is identical to that discussed in connection with FIG. 5 above.

Figure 9:
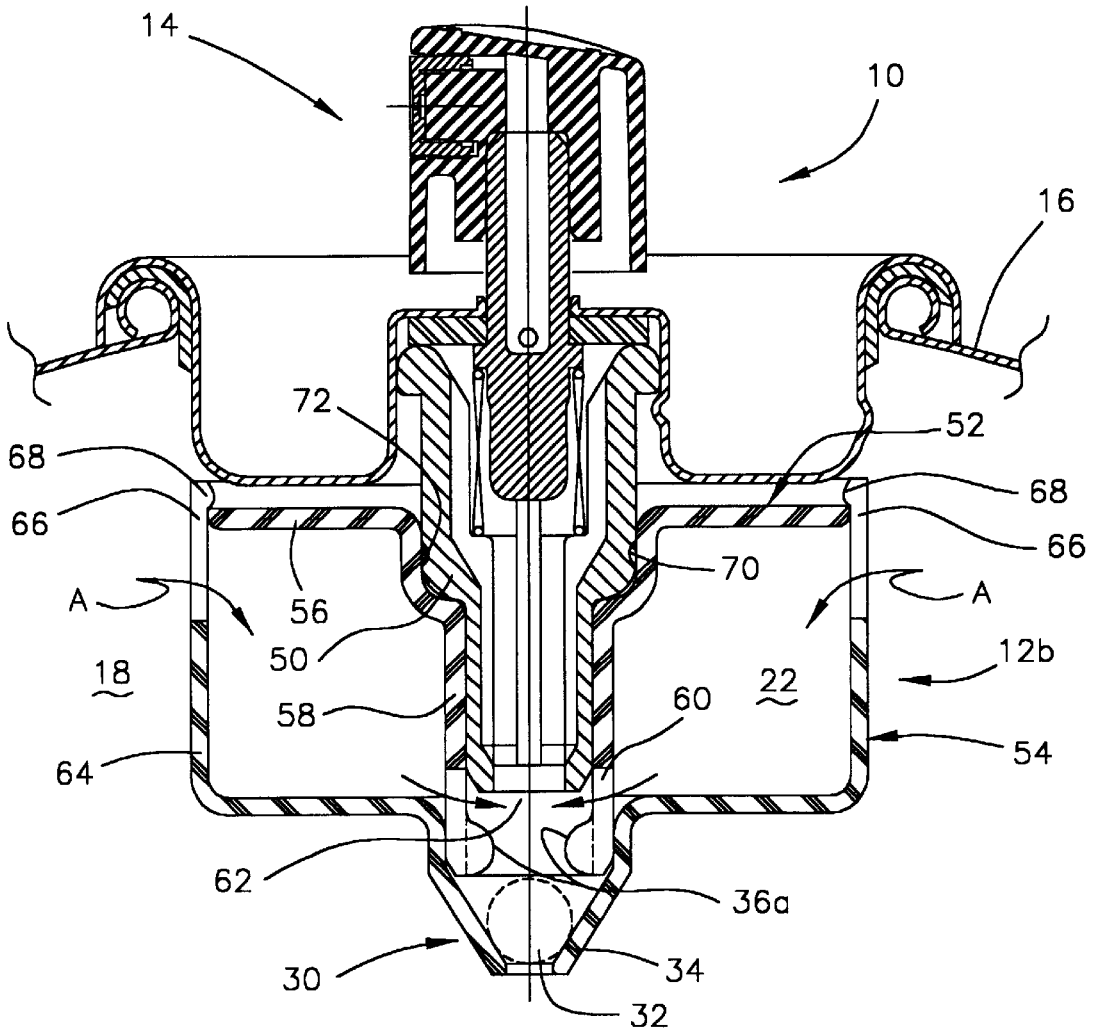
FIG. 9 is a side sectional view of an aerosol spray dispenser including an alternative embodiment of an insert member in accordance with the present invention.
Figure 10:
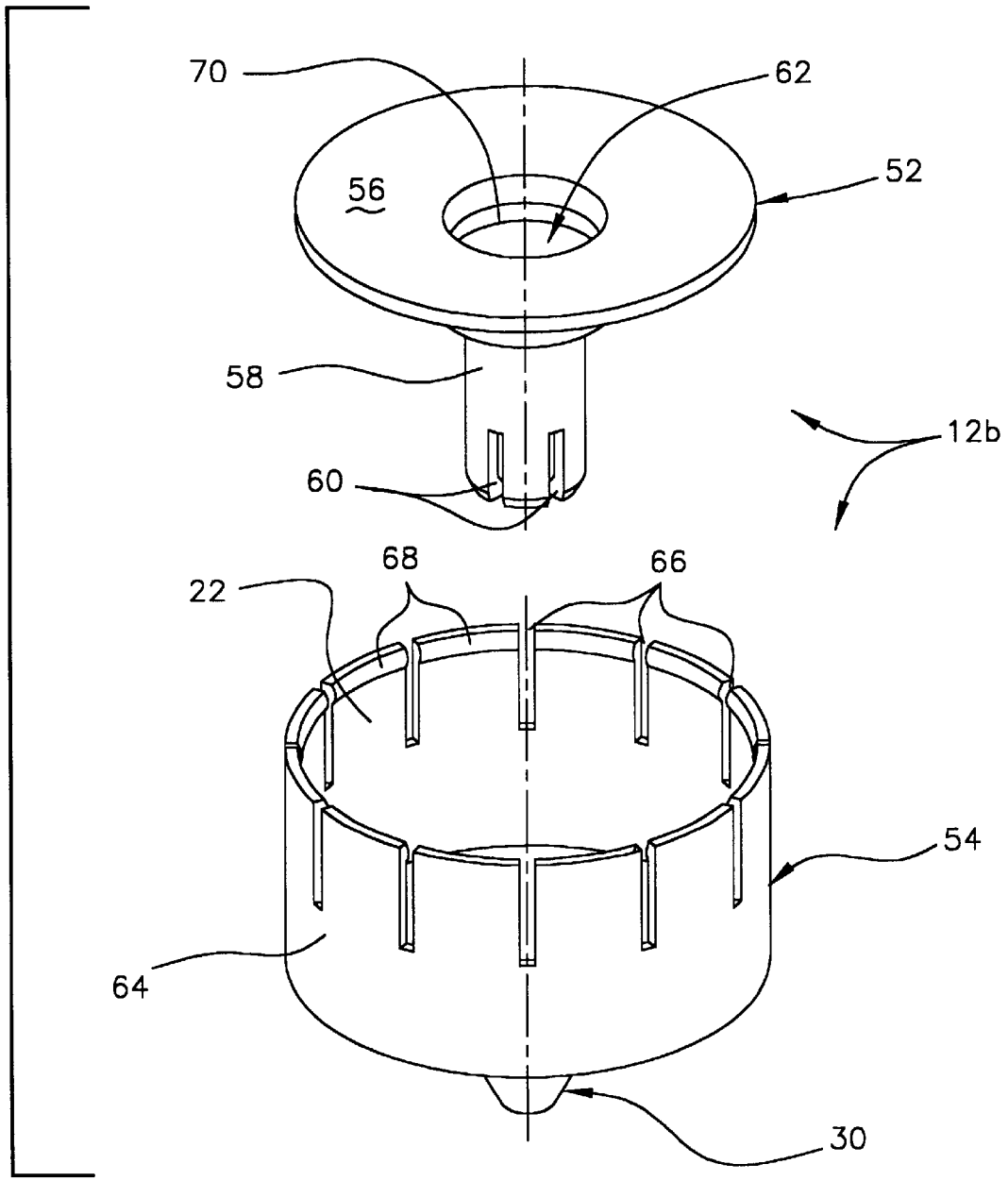
FIG. 10 is a perspective exploded view of the insert member of FIG. 9.

FIGS. 9 and 10 show an insert member 12*b* in accordance with a further alternative embodiment of the present invention, which is also primarily for use in aerosol applications. Insert member 12*b* is a two-piece structure having a base member 52 adapted to be attached to a downwardly extending member or component of spray assembly 14, and an outer tank member 54 adapted to be connected with base member 52 so as to define active reservoir area 22 therebetween. Base member 52 and outer tank member 54 together define insert member 12*b* having a wider and shorter shape which may be desirable in particular types or shapes of dispensers.

Top member 52 preferably includes a flange member 56 sized to engage with a sidewall of tank member 54, for example through a snap fit. Base member 52 has a downwardly extending tube portion 58 extending into outer tank member 54 and having a plurality of slots 60. Tube portion 58 defines an interior flow passage 62. Slots 60 allow flow from active reservoir area 22 through interior flow passage 62 and into the aerosol spray nozzle assembly 14 as desired.

Outer tank member 54 preferably includes sidewall portion 64 defining active reservoir area 22 and sized to engage with flange 56, and also preferably includes slots 66 as an inlet for allowing liquid to flow from the main reservoir area into active reservoir area 22 as desired. Sidewall 64 may be provided with a ridge 68 extending inwardly to snap over and engage flange 56. Outer tank 54 preferably also includes a valve member 30 which may be substantially as described above. Alternatively, tube portion 58 could be provided with ball retainers 36*a* if desired, or tube portion 58 could be provided having a lower edge sized to hold ball 32 in place without retainers 36*a*. In the embodiment of FIGS. 9 and 10, insert member 12*b* is provided with a ridge 70 extending radially inwardly from base member 52 to engage in a notch 72 on member 50 so as to firmly mount insert member in place as desired. Of course, ridge 70 could be positioned on member 50 with notch 72 on insert member 12*b* as well.

Insert member 12*b* in accordance with the embodiment of FIG. 8 operates in similar manner to the embodiments discussed above.

Figure 11:
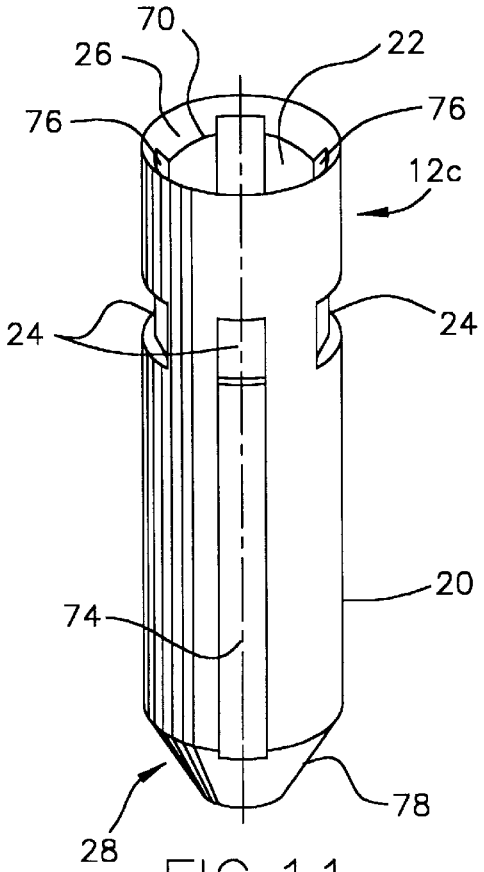
FIG. 11 is a perspective view of an alternative embodiment of an insert member for use in finger pump and/or narrow-diameter containers in accordance with the present invention.
Figure 12:
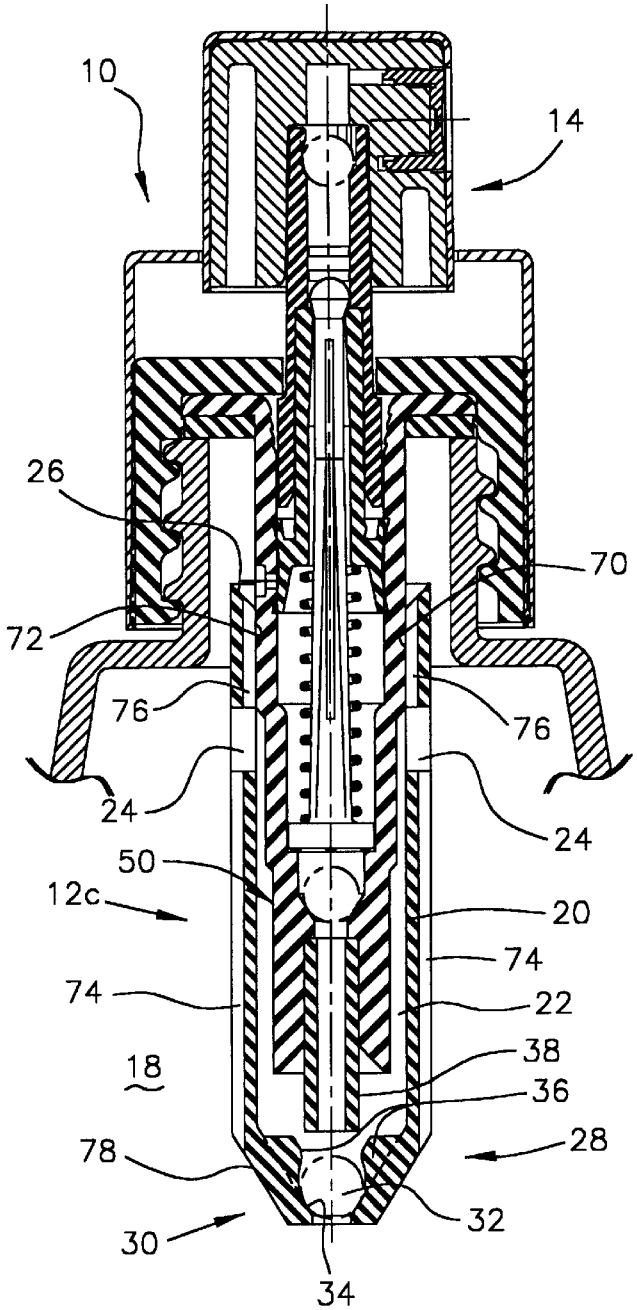
FIG. 12 is a side sectional view of the insert member of FIG. 11.

FIGS. 11 and 12 illustrate an alternative embodiment of an insert member 12*c* according to the present invention which is well suited for use with containers having narrow necks or neck openings such as finger spray dispensers commonly used for dispensing perfume and the like. FIG. 12 shows a typical spray assembly for a non-aerosol finger spray dispenser having a nozzle or pump assembly 14. Assembly 14 typically includes a downwardly extending member 50 which may contain various known structural components of the spray assembly. It should be apparent that a container having a long narrow neck would leave very little room for insert member 12*c* or flow thereto.

In accordance with this embodiment of the invention, insert member 12*c* is adapted to engage member 50 and still operate as desired. Also, member 12*c* has a narrow diameter which allows insertion into a narrow-opening neck 40 as may be desired.

Insert member 12*c* of FIGS. 11–12 preferably includes a sidewall 20 including an inlet defined by openings or slots 24, and a valve member 30 for example including ball member 32, seat 34 and ball retainers 36 as shown. These components function in similar manner to those described in connection with FIGS. 1–10. Insert member 12*c* in this embodiment is advantageously provided with a series of radially outwardly opening flow passages 74 which preferably extend from slots 24 toward closed end 28. Radially inwardly opening passages 76 may also be positioned extending from slots 24 toward open upper end 26.

Flow passages 74 are particularly advantageous in connection with any containers having a narrow neck which could otherwise interfere with flow from main reservoir area 18 into active reservoir area 22 as desired. Flow passages 76 are also advantageous and may allow desirable flow of liquid upwardly from the open upper end 26 of insert member 12*c* if necessary depending upon the particular structure of nozzle or spray assembly in use.

It is preferred that passages 74 extend either to the lower end 28 of insert member 12*c,* or at least beyond the length of the narrow neck of the container in question to allow for unrestricted flow. Passages 74, 76 allow insert member 12*c* to be used with containers having a neck portion 40 of approximately the same inner diameter as the outer diameter of insert member 12*c*. Passage 74 allows flow into active reservoir area 22 which might otherwise be blocked by a snug fit between neck portion 40 and insert member 12*c*.

Slots or openings 24 may preferably be positioned so as to be substantially adjacent to the neck opening of a container so that when the container is in the inverted position, openings 24 are at the base of the neck area. This maximizes the fill of active reservoir area 22 when reinverted to the upright position.

As shown in FIGS. 11 and 12, insert member 12*c* may also suitably be provided having a substantially cone-shaped exterior surface 78 on closed end 28 which, in this embodiment, serves to enhance the ability for liquid to flow into fluid passages 74 as desired.

The embodiment of FIGS. 11 and 12 is ideal for use with a finger pump spray dispenser such as a perfume dispenser, and operates in substantially the same way as the embodiments of the invention utilizing insert members 12, 12*a* or 12*b*. Specifically, dispenser 10 is inverted so as to allow liquid product to flow from a main reservoir area through passages 74 and openings or slots 24 and into active reservoir area 22. Dispenser 10 can then be operated inverted if desired, or can be returned to an upright position wherein valve member 30 closes by gravity and active reservoir area 22 contains sufficient liquid product for a desired number of applications from dispenser 10.

The insert member of the present invention may suitably be manufactured through injection molding or any other desirable technique, and may be provided of any suitable material. Factors dictating the type of material will include compatibility with the liquid and/or propellant within dispenser 10 to which the insert member will be exposed, structural considerations and manufacturing considerations. Valve member 30 may include ball member 32 as a stainless steel ball or any other suitable structure.

In each of the above-described embodiments of the present invention, it is preferred that valve member 30 be configured so as to provide a good seal against liquid flow in an upright position. During manufacture, it may be desirable after molding to subject valve member 30 to a vacuum equivalent to about 15 inches of mercury for about three seconds to ensure manufacture of a valve with good sealing properties.

It should be noted that although the present disclosure is made in terms of an insert: member to be mounted within a container, it is well within the scope of the invention to incorporate the insert member as an integral or otherwise connected structure with the container.

In all of the disclosed embodiments, it should be readily appreciated that an apparatus has been provided whereby a spray and/or aerosol dispenser can be used to accomplish inverted and/or upright dispensing of liquid in an easy and reliable manner. Thus, each and every object of the present invention has been attained.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A dispenser, comprising:

a container defining a main reservoir for holding a liquid product;

a nozzle assembly connected to said container for dispensing liquid from said container;

an inner tank member disposed in said container and defining an active reservoir for holding said liquid product, said inner tank member including an inlet communicating said active reservoir with said main reservoir and an outlet, said nozzle assembly being communicated with said active reservoir; and a valve positionable in said outlet between a blocking position wherein said inlet is open and said outlet is blocked, and a filling position wherein said inlet and said outlet are open.

2. A dispenser according to claim 1, wherein said inner tank member comprises a sidewall defining said active reservoir and having a top and a bottom, said inlet being positioned higher on said sidewall than said outlet.

3. A dispenser according to claim 1, wherein said valve comprises a ball member sealably positionable in said outlet.

4. A dispenser according to claim 1, wherein said nozzle assembly includes a dip tube disposed in said active reservoir.

5. A dispenser according to claim 1, wherein said container has a neck portion for receiving said nozzle assembly, and wherein said inner tank member includes means for engaging said neck portion.

6. A dispenser according to claim 1, wherein said container contains said liquid product at a pressure higher than ambient pressure.

7. A dispenser according to claim 1, wherein said inner tank member is mounted to said nozzle assembly.

8. A dispenser according to claim 1, wherein said inner tank member comprises a substantially cylindrical member having an upper end adapted to communicate with said nozzle assembly, and having a lower end extending into said main reservoir, wherein said inlet is positioned spaced from said lower end, and further comprising at least one flow passage extending along said cylindrical member from said inlet toward said lower end.

9. A dispenser according to claim 8, wherein said flow passage comprises a groove opening radially outwardly in said cylindrical member.

10. A dispenser according to claim 9, further comprising at least one additional flow passage extending along said cylindrical member from said inlet to said upper end.

11. A dispenser according to claim 10, wherein said additional flow passage comprises a groove opening radially inwardly in said cylindrical member.

12. A tank insert for a dispenser, comprising a substantally cylindrical member having a sidewall defining an inner space and having an open end and a valved end; an inlet in said sidewall for allowing flow from exterior of said member to said inner space; an outlet in said valved end; and a valve in said valved end for selectively blocking and allowing flow through said valved end and positionable between a blocking position wherein said inlet is open and said outlet is blocked, and a filling position wherein said inlet and said outlet are open.

13. An insert according to claim 12, wherein said valve comprises a gravity operated valve which positions itself by gravity in said blocking position for blocking flow when said member is in a substantially upright position with said open end above said closed end, and wherein said valve positions itself by gravity in said filling position for allowing flow when said member is in a substantially inverted position with said open end below said closed end.

14. An insert according to claim 12, wherein said valve comprises a ball and a chamber having an opening, a seat for said ball and a retainer for movably retaining said ball in said chamber.

15. An insert according to claim 12, further comprising means on said sidewall for internally engaging a dispenser.

16. An insert according to claim 15, wherein said means for internally engaging comprises a flange extending radially outwardly from said open end for engaging a neck of said dispenser.

17. An insert according to claim 15, wherein said means for internally engaging comprises a member extending radially inwardly from said open end for engaging a pump structure of said dispenser.

18. An insert according to claim 12, further comprising at least one passage extending from said inlet toward said valved end.

19. An insert according to claim 18, wherein said passage comprises a groove opening radially outwardly in said sidewall.

20. An insert according to claim 19, further comprising at least one additional flow passage extending along said cylindrical member from said inlet to said upper end.

21. A dispenser according to claim 20, wherein said additional flow passage comprises a groove opening radially inwardly in said cylindrical member.

* * * * *